US008444234B2

(12) United States Patent
Kim et al.

(10) Patent No.: US 8,444,234 B2
(45) Date of Patent: May 21, 2013

(54) WASHING MACHINE

(75) Inventors: Dongyoon Kim, Changwon-si (KR); Youngbae Park, Changwon-si (KR); Sunggi Hwang, Changwon-si (KR); Dongmin Kim, Changwon-si (KR); Seogkyu Park, Changwon-si (KR); Taehyok Kwon, Changwon-si (KR); Taehyeon Sim, Changwon-si (KR); Jongdeuk Bae, Changwon-si (KR); Jaeseok Lim, Changwon-si (KR); Seongno Yoon, Changwon-si (KR); Younggon Kim, Changwon-si (KR); Jimaeng Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 342 days.

(21) Appl. No.: 12/845,316

(22) Filed: Jul. 28, 2010

(65) Prior Publication Data

US 2011/0050059 A1 Mar. 3, 2011

Related U.S. Application Data

(60) Provisional application No. 61/230,494, filed on Jul. 31, 2009, provisional application No. 61/230,510, filed on Jul. 31, 2009, provisional application No. 61/230,590, filed on Jul. 31, 2009, provisional application No. 61/230,613, filed on Jul. 31, 2009.

(30) Foreign Application Priority Data

| | | |
|---|---|---|
| Jul. 31, 2009 | (KR) | 10-2009-0071056 |
| Jul. 31, 2009 | (KR) | 10-2009-0071057 |
| Jul. 31, 2009 | (KR) | 10-2009-0071058 |
| Jul. 31, 2009 | (KR) | 10-2009-0071059 |
| Oct. 22, 2009 | (KR) | 10-2009-0100847 |
| Oct. 22, 2009 | (KR) | 10-2009-0100849 |
| Oct. 22, 2009 | (KR) | 10-2009-0100850 |
| Oct. 22, 2009 | (KR) | 10-2009-0100853 |

(51) Int. Cl.

| | |
|---|---|
| ***A47K 1/04*** | (2006.01) |
| ***A47B 88/00*** | (2006.01) |
| ***E05D 11/06*** | (2006.01) |
| ***D06F 17/00*** | (2006.01) |
| ***B08B 6/00*** | (2006.01) |

(52) U.S. Cl.

USPC ..... 312/228; 312/328; 16/374; 68/196; 134/200

(58) Field of Classification Search

USPC ..... 312/228, 327, 328, 138.1; 16/352, 16/374, 375; 220/825, 833, 831, 810; 68/196; 134/200

See application file for complete search history.

(56) References Cited

U.S. PATENT DOCUMENTS 1,263,895 A * 4/1918 Hubbard ..... 16/251
2,617,702 A * 11/1952 Manning et al. ..... 312/296

(Continued)

FOREIGN PATENT DOCUMENTS

| | | |
|---|---|---|
| CN | 1456738 A | 11/2003 |
| JP | 3-191995 A | 8/1991 |
| JP | 3-191996 A | 8/1991 |

*Primary Examiner* — David Dunn
*Assistant Examiner* — Ryan A Doyle
(74) *Attorney, Agent, or Firm* — Birch, Stewart, Kolasch & Birch, LLP

(57) ABSTRACT

A washing machine of the present invention comprises a top cover where a laundry entrance hole is formed through which laundry is put in from above; a lid assembly coupled to the top cover in a rotatable manner and opening and closing the laundry entrance hole; and a stopper being formed at least in one of the top cover and the lid assembly and preventing the lid assembly from being rotated more than a maximum opening angle. The stopper prevents a lid assembly from being rotated more than a maximum opening angle.

16 Claims, 12 Drawing Sheets

U.S. PATENT DOCUMENTS

| | | | | |
|---|---|---|---|---|
| 3,952,369 | A * | 4/1976 | Erickson | 16/265 |
| 4,115,901 | A * | 9/1978 | Schmidt | 16/374 |
| 4,787,121 | A * | 11/1988 | Racenis et al. | 16/356 |
| 4,914,781 | A * | 4/1990 | Sokn et al. | 16/225 |
| 5,441,167 | A * | 8/1995 | Shigeru | 220/830 |
| 6,074,030 | A * | 6/2000 | Prunty et al. | 312/404 |
| 6,092,690 | A * | 7/2000 | Bitowft et al. | 220/831 |
| 6,282,927 | B1 * | 9/2001 | Wunderlich et al. | 68/3 R |
| 6,986,434 | B1 * | 1/2006 | Getsy et al. | 220/254.3 |
| 2003/0098313 | A1 * | 5/2003 | Cheng | 220/840 |
| 2004/0068951 | A1 * | 4/2004 | Bienick et al. | 52/455 |
| 2005/0281607 | A1 * | 12/2005 | Kato | 400/693 |
| 2006/0101873 | A1 * | 5/2006 | Kim et al. | 68/196 |
| 2006/0254323 | A1 * | 11/2006 | Kim | 68/235 R |
| 2007/0107473 | A1 * | 5/2007 | Park | 68/12.14 |
| 2008/0083768 | A1 * | 4/2008 | Luburic | 220/810 |
| 2008/0245112 | A1 * | 10/2008 | Sung | 68/12.26 |
| 2009/0229313 | A1 * | 9/2009 | Yoo et al. | 68/12.26 |
| 2009/0229320 | A1 * | 9/2009 | Yoo et al. | 68/3 R |

* cited by examiner

WASHING MACHINE

This application claims priority from Korean Patent Application Nos. 10-2009-0071056, 10-2009-0071057, 10-2009-0071058, 10-2009-0071059 filed on Jul. 31, 2009, and Korean Patent Application Nos. 10-2009-0100847, 10-2009-0100849, 10-2009-0100850, 10-2009-0100853 filed on Oct. 22, 2009 in the Korean Intellectual Property Office, and U.S. Provisional Application Nos. 61/230,590, 61/230,613, 61/230,510, 61/230,494 filed on Jul. 31, 2009, in the USPTO, the disclosure of which is incorporated herein by reference in its entirety.

BACKGROUND

1. Field

The present invention relates to a washing machine. More specifically, the present invention relates to a washing machine which prevents a lid assembly from colliding with a control panel and being damaged when a laundry entrance hole is opened as the lid assembly rotates.

2. Description of the Related Art

In general, various devices for handling laundry by applying a physical and chemical process are collectively called a washing machine; examples include a washing device for removing contamination of clothes, bedclothes, and the like (referred to as 'laundry' or 'linen' afterwards) by chemical decomposition by water and detergent and physical interaction between water and laundry; a drying machine for drying wet laundry by spin drying; and a refresher for doing laundry easily by spraying heated steam over laundry thus to prevent allergy due thereto.

Meanwhile, a washing machine which is one kind of a laundry handling device, depending on the structure and employed washing method thereof, is classified into one of an agitator type, a drum type, and a pulsator type. A conventional washing machine washes laundry by performing a cleaning, a rinsing, and a spin drying course sequentially. Also, only the one selected from the three courses can be performed by the user's selection and an appropriate washing method is employed according to the type of laundry.

BRIEF SUMMARY OF THE INVENTION

A washing machine of the present invention comprises a top cover where a laundry entrance hole is formed through which laundry is put in from above; a lid assembly coupled to the top cover in a rotatable manner and opening and closing the laundry entrance hole; and a stopper being formed at least in one of the top cover and the lid assembly and preventing the lid assembly from being rotated more than a maximum opening angle.

A washing machine of the present invention, equipped with a stopper restricting rotation of a lid assembly, prevents the lid assembly from making contact with a control panel during rotation.

Also, a stopper supports the weight of a lid assembly, thereby preventing the lid assembly from colliding with a control panel and being damaged.

At the same time, a protruding part makes contact with a control panel, preventing a lid assembly from rotating more than a maximum opening angle.

In addition, a stopper makes surface contact with a lid assembly, increasing support for the lid assembly.

Moreover, a protruding part formed at a stopper supports a lid assembly, increasing support for the lid assembly.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION

Advantages and characteristics of the present invention and a method to achieve the same will be made clear with reference to embodiments described in detail later with appended drawings. The present invention, however, is not limited to embodiments described below and can be implemented in various forms different from each other. The present embodiments are provided only to complete the disclosure of the present invention and to inform those skilled in the art to which the present invention belongs about the scope of the invention; and the present invention is to be understood only by the scope of claims. The same reference symbols correspond to the same constituting elements throughout the document.

Figure 1:
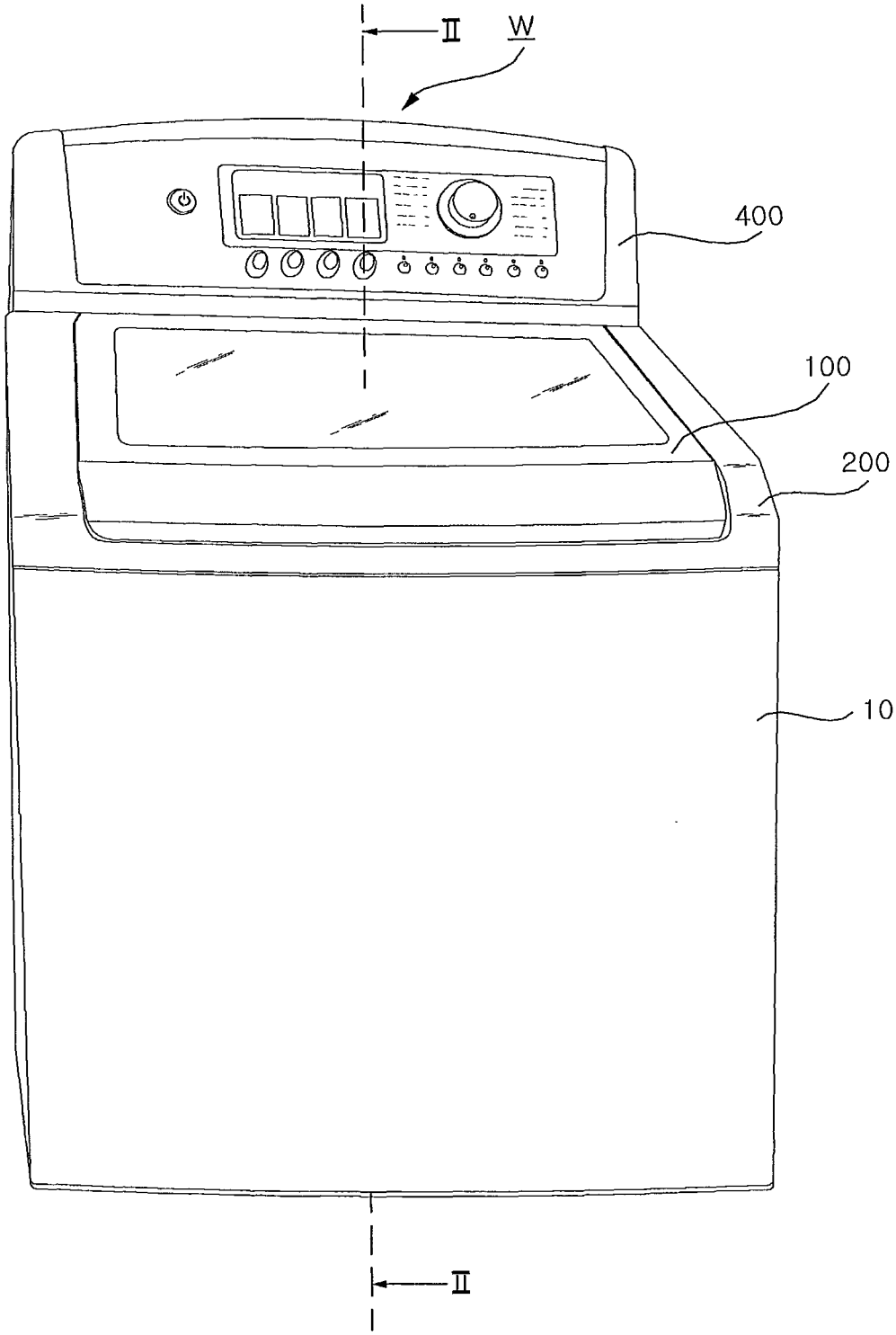
FIG. 1 illustrates a perspective view of one embodiment of a washing machine according to the present invention.
Figure 2:
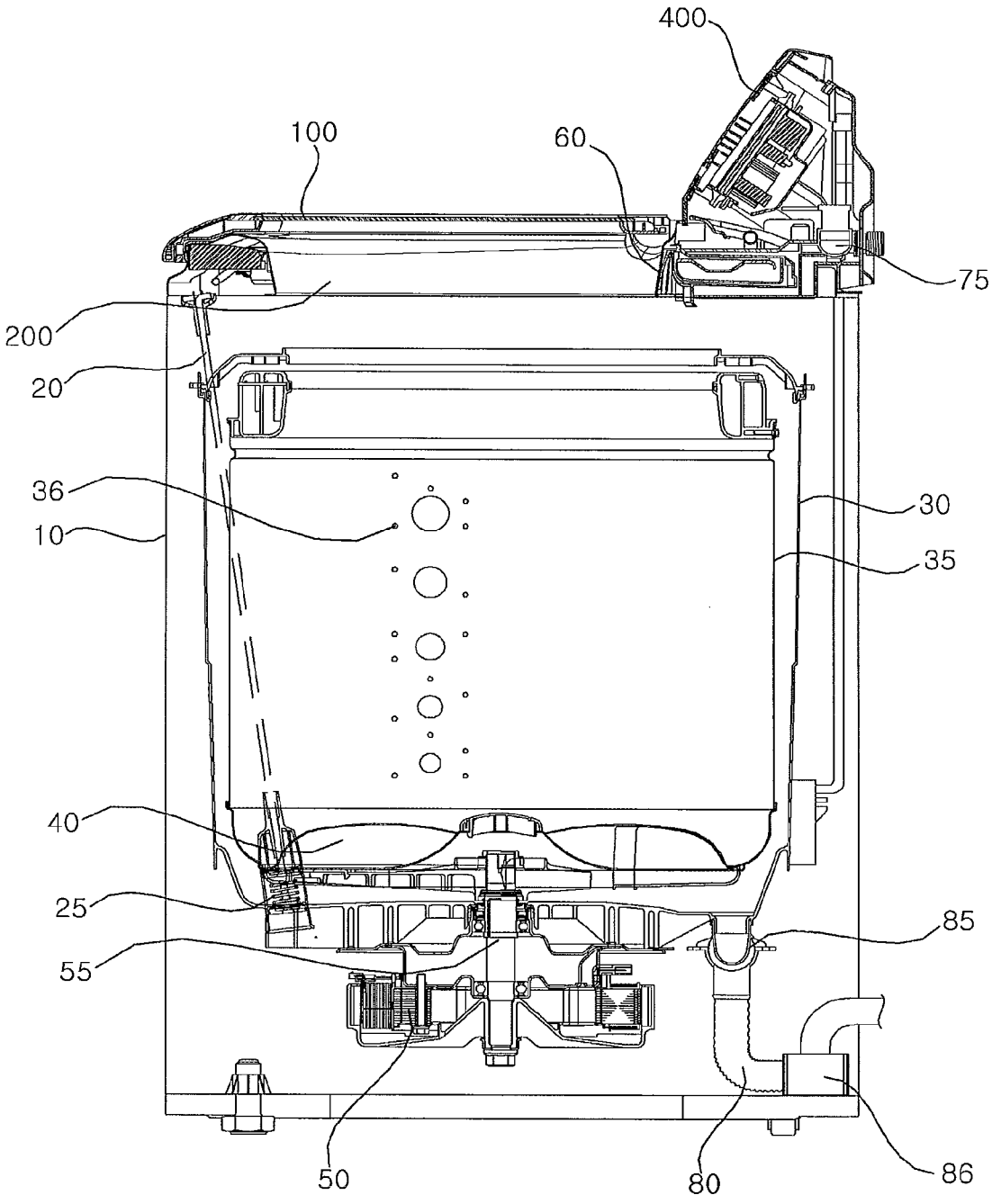
FIG. 2 illustrates a cross sectional view of FIG. 1 as seen along II-II line.
Figure 3:
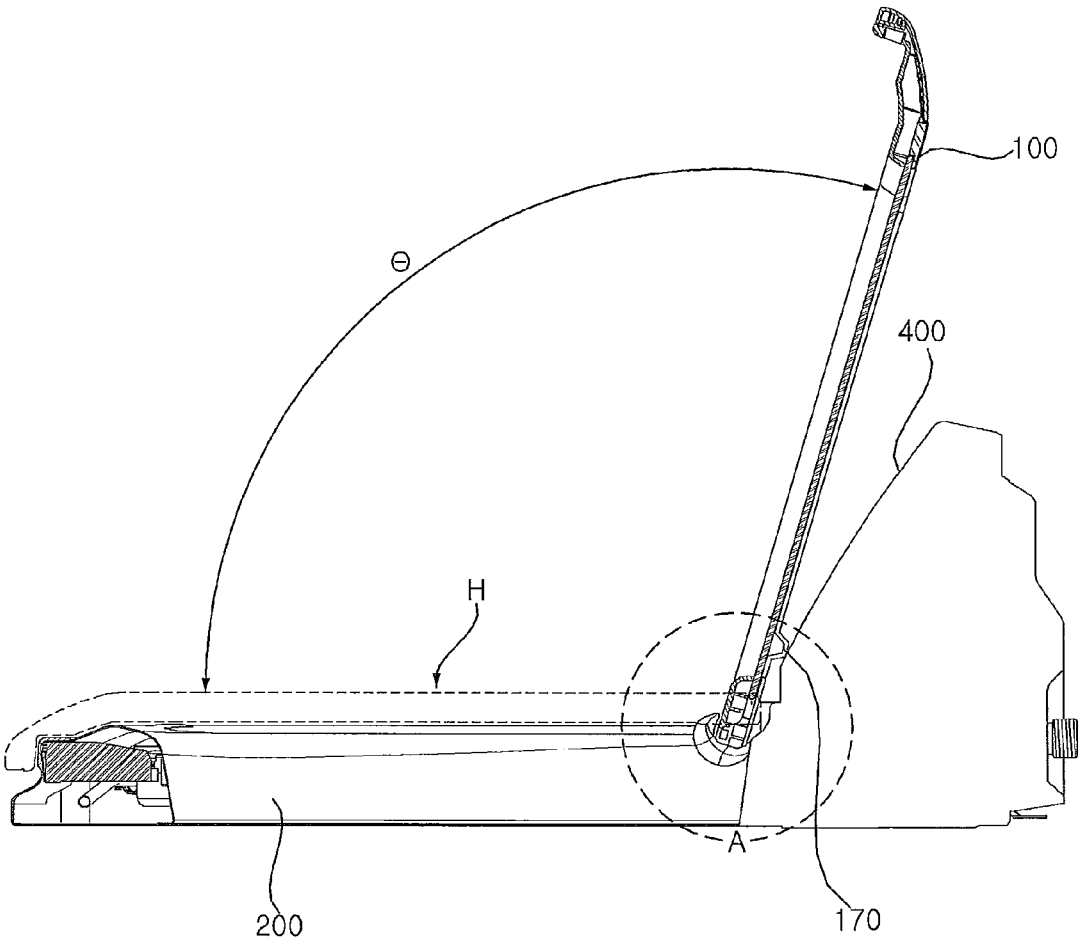
FIG. 3 illustrates a side view of a lid assembly and a top cover according to one embodiment of the present invention.
Figure 4:
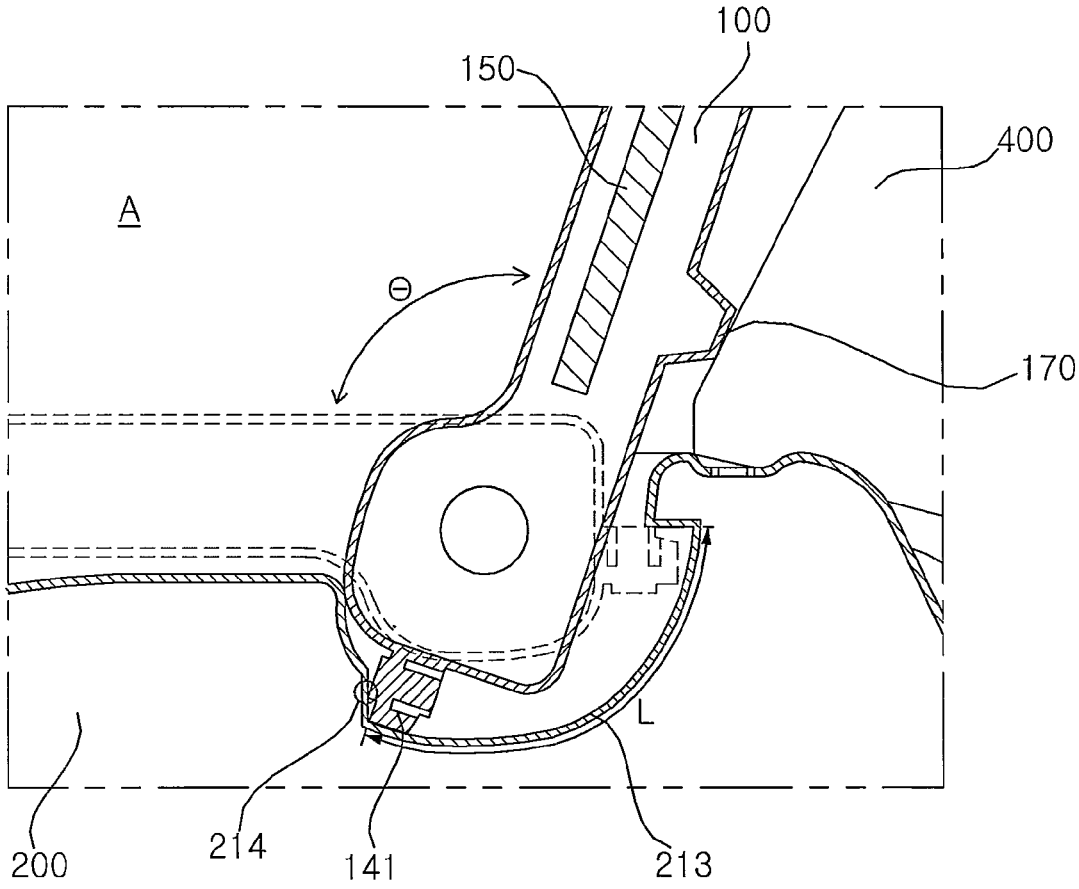
FIG. 4 illustrates a magnified view of A part of FIG. 3.
Figure 5:
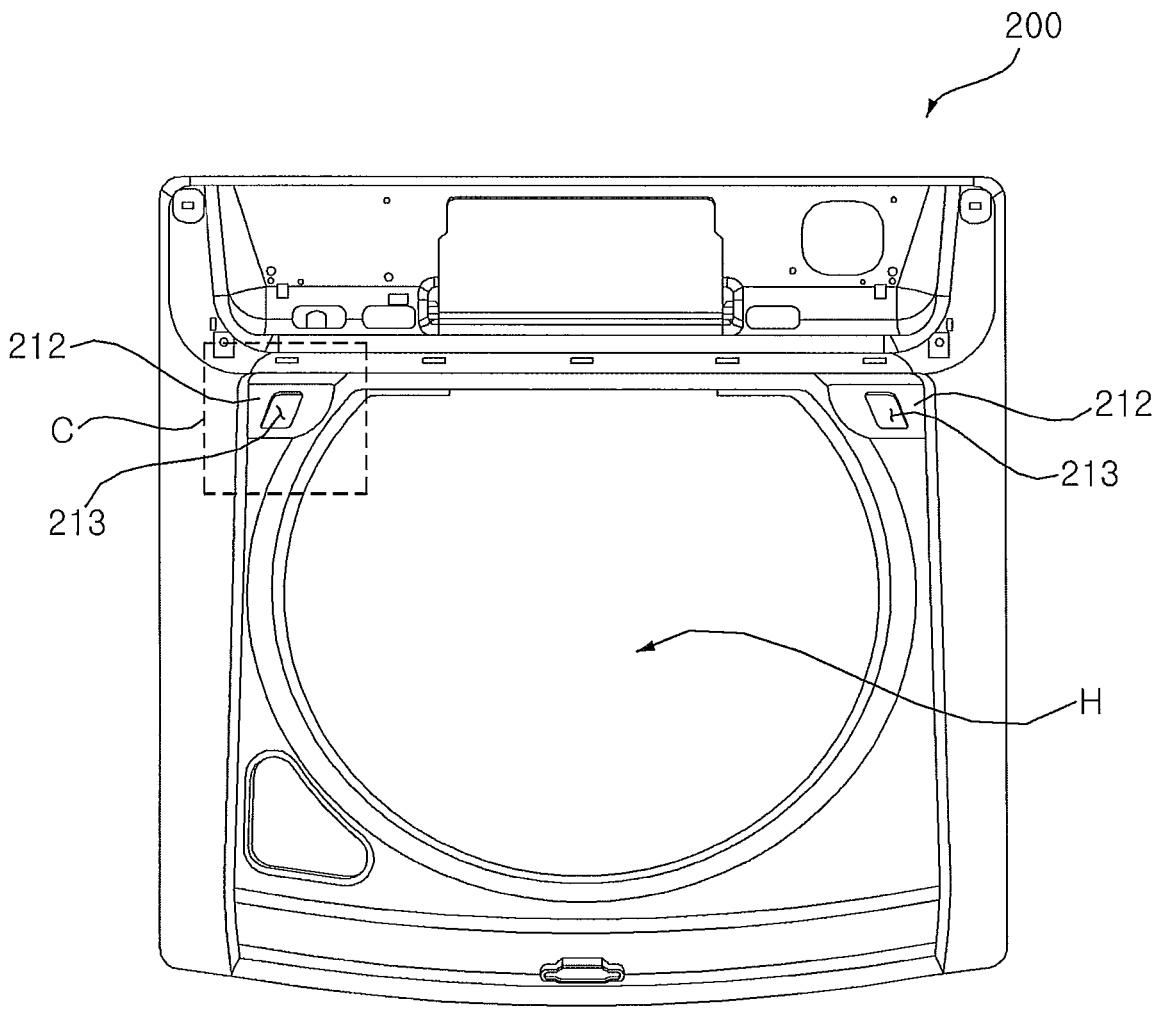
FIG. 5 illustrates a top view of a top cover where a mounting part according to one embodiment of the present invention is indicated.
Figure 6:
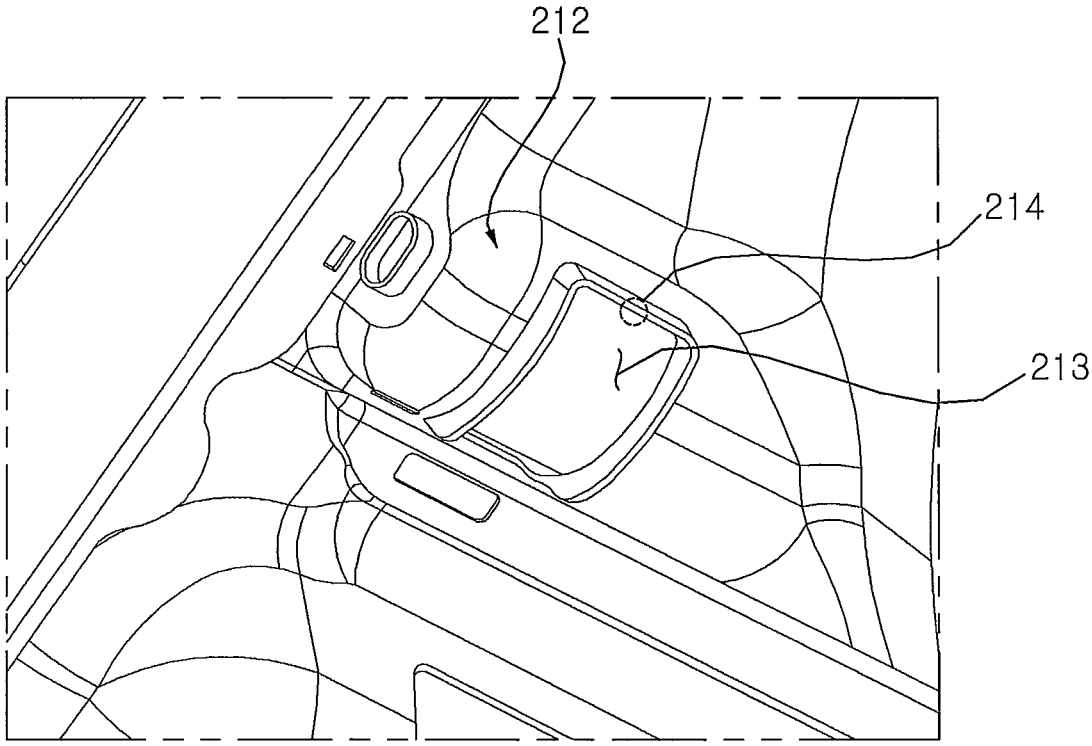
FIG. 6 illustrates a magnified view of C part as seen from below.
Figure 7:
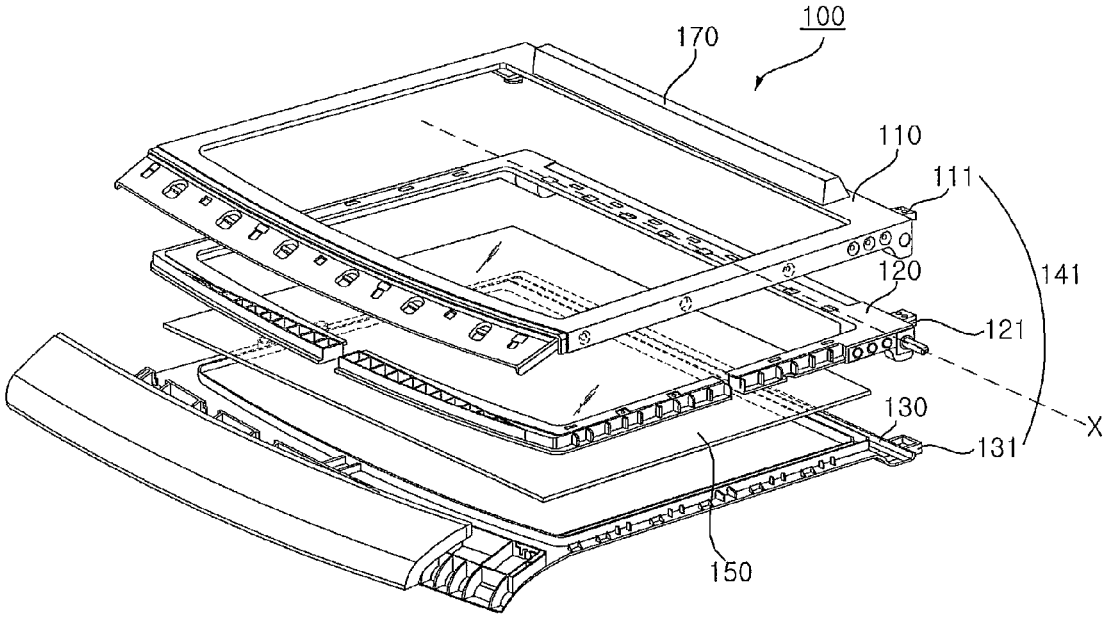
FIG. 7 illustrates a perspective view of decomposition of a lid assembly according to one embodiment of the present invention.
Figure 8:
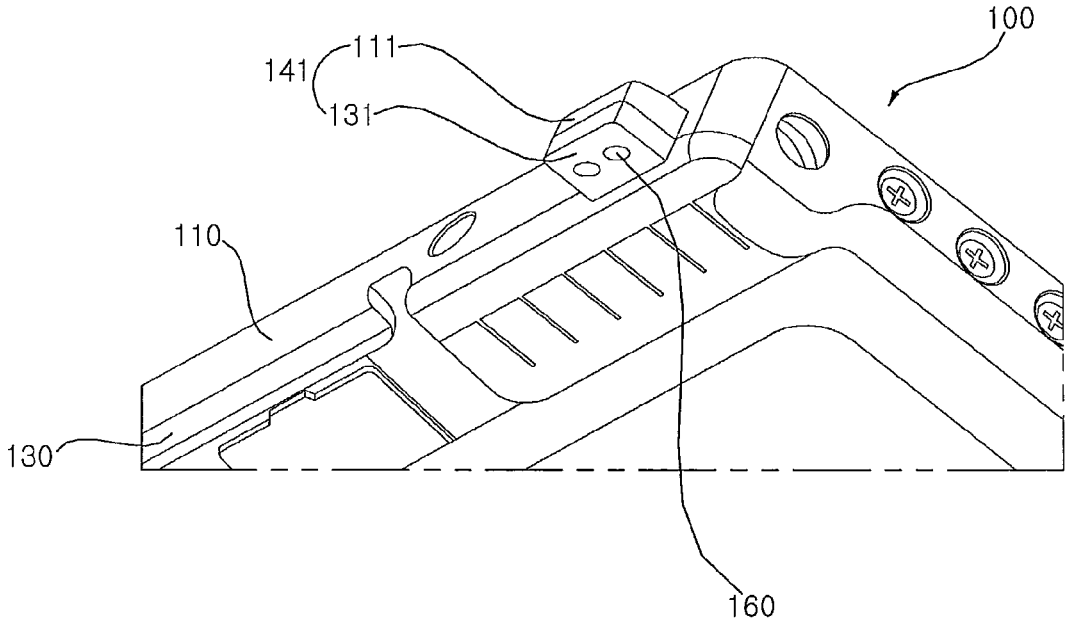
FIG. 8 illustrates a magnified view of a part of a lid assembly to which a stopper according to one embodiment of the present invention is fastened.
Figure 9:
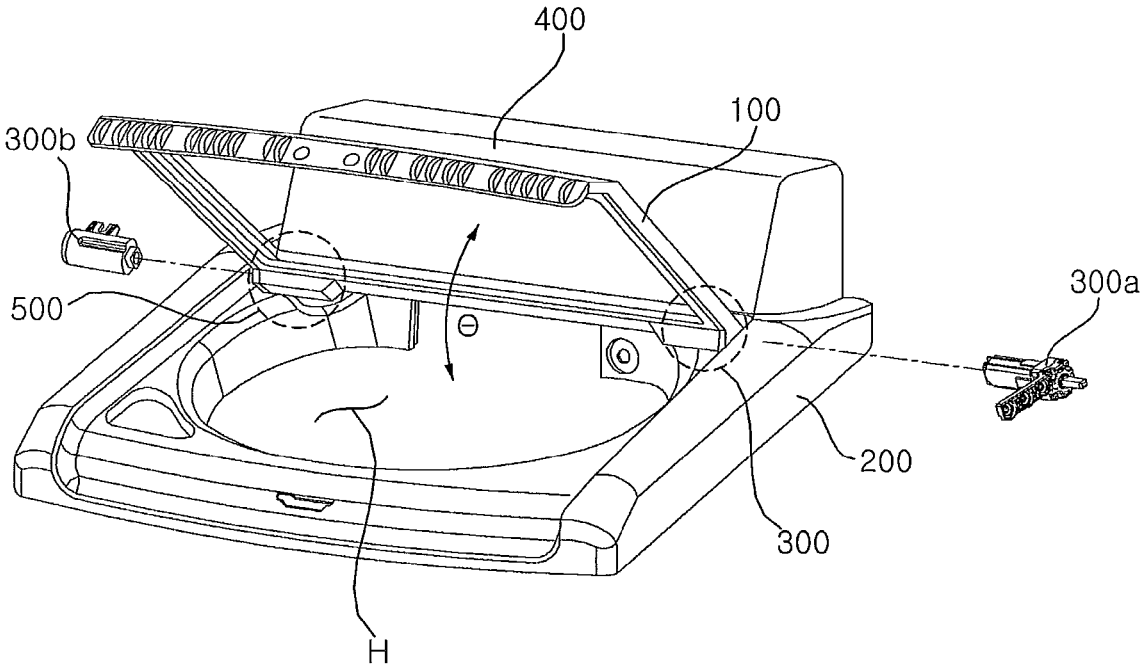
FIG. 9 illustrates a lid assembly and a top cover according to one embodiment of the present invention.
Figure 10:
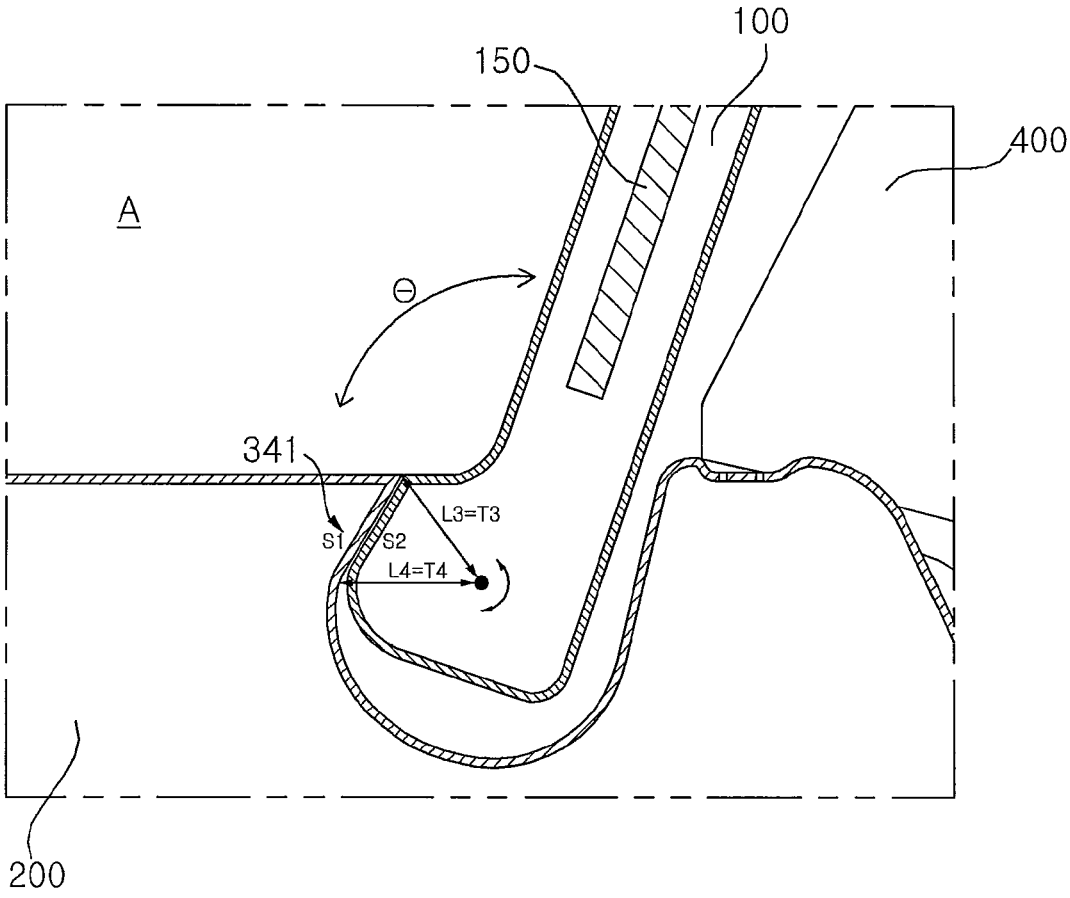
FIG. 10 illustrates another embodiment of the present invention for A part of FIG. 3.
Figure 11:
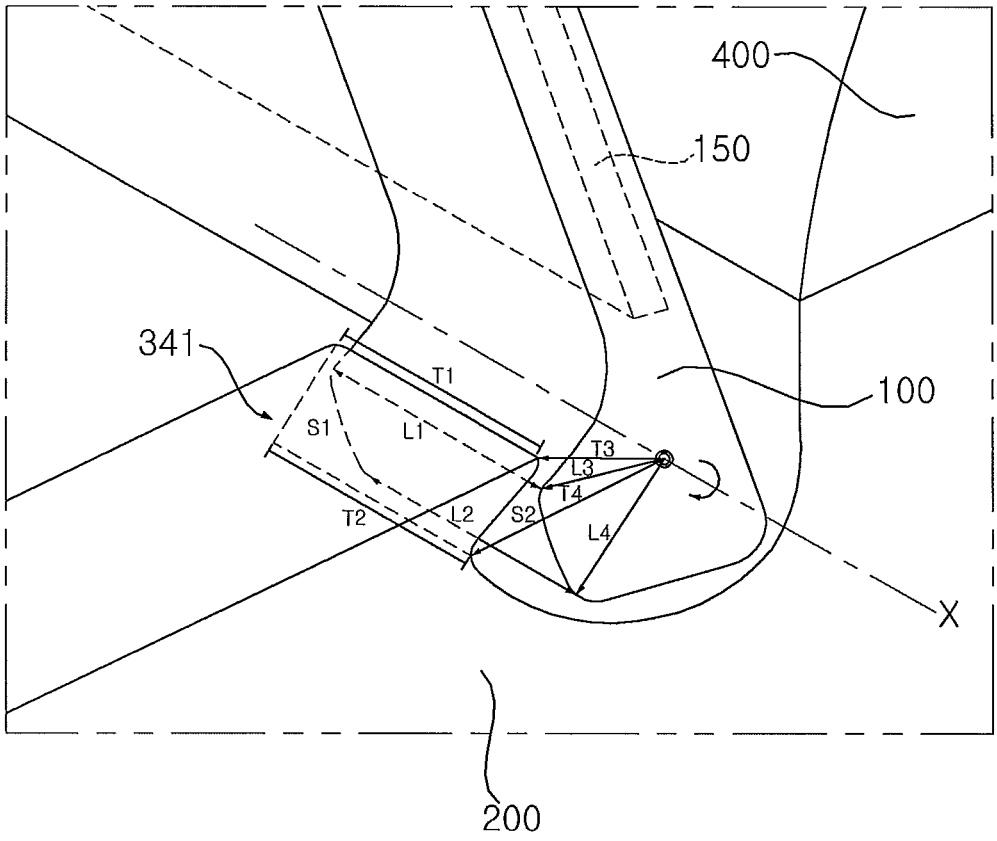
FIG. 11 illustrates a perspective view of A part.

FIG. 1 illustrates a perspective view of one embodiment of a washing machine according to the present invention. FIG. 2 illustrates a cross sectional view of FIG. 1 as seen along II-II line. FIG. 3 illustrates a side view of a lid assembly and a top cover according to one embodiment of the present invention; and FIG. 4 illustrates a magnified view of A part of FIG. 3. FIG. 5 illustrates a top view of a top cover where a mounting part according to one embodiment of the present invention is indicated and FIG. 6 illustrates a magnified view of C part as seen from below. FIG. 7 illustrates a perspective view of decomposition of a lid assembly according to one embodiment of the present invention. FIG. 8 illustrates a magnified view of a part of a lid assembly to which a stopper according to one embodiment of the present invention is fastened. FIG. 9 illustrates a lid assembly and a top cover according to one embodiment of the present invention. FIG. 10 illustrates another embodiment of the present invention for A part of FIG. 3 and FIG. 11 illustrates a perspective view of A part.

Figure 12:
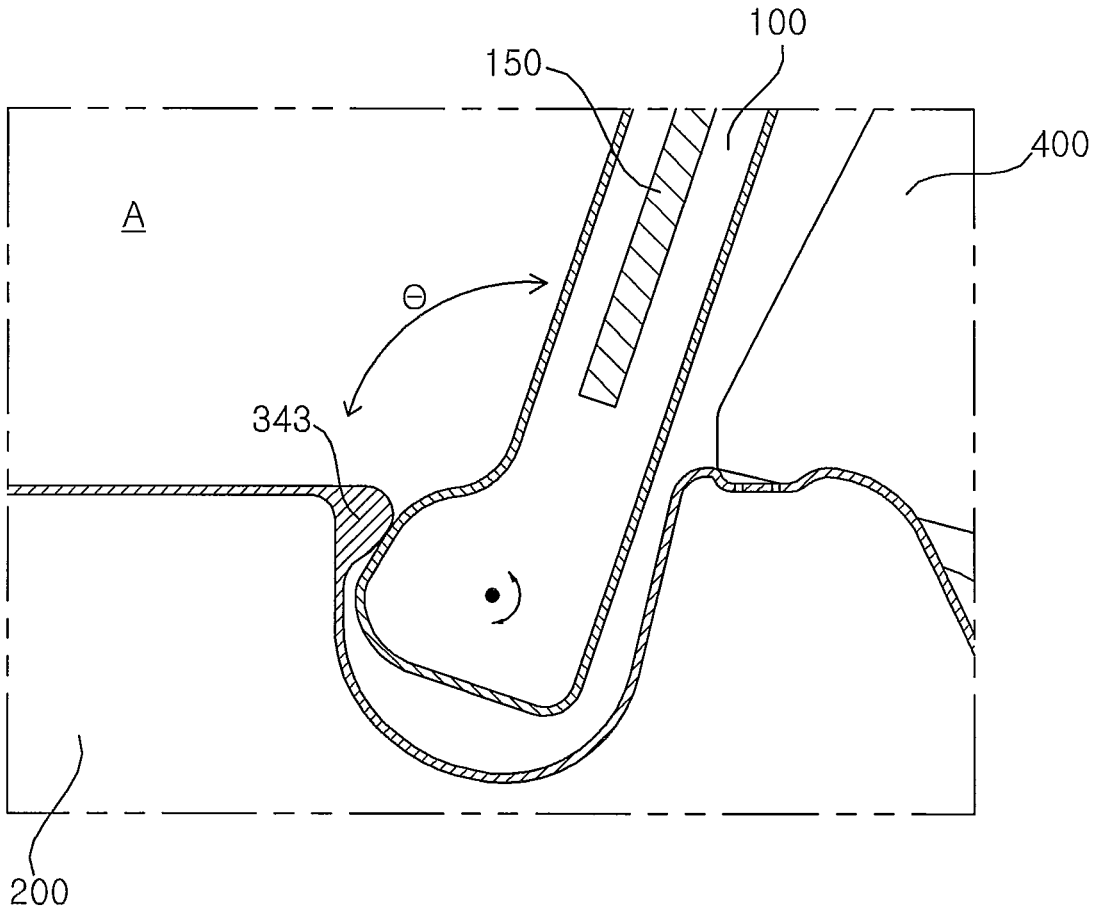
FIG. 12 illustrates a stopper according to another embodiment of the present invention.

FIG. 12 illustrates a stopper according to another embodiment of the present invention. In what follows, the present invention will be described in more detail with reference to FIGS. 1 to 12.

With reference to FIGS. 1 and 2, a washing machine W comprises a cabinet 10; a top cover 200 disposed in an upper side of the cabinet 10; a lid assembly 100 disposed in the front part of an upper side of the top cover 200; and a control panel 400 disposed in the rear part of an upper side of the top cover 200 and providing an interface through which the user can operate the washing machine.

An outer tub 30 hanged by a supporting element 20 is disposed inside the cabinet 10 and an inner tub 35 is disposed inside the outer tub 30 in a rotatable manner.

A damper 25 compensating fluctuation of the outer tub 30 due to vibration generated by rotation of the inner tub 35 is disposed in a lower part of the supporting element 20; on the floor of the inner tub 35, disposed is a pulsator 40 for forming a rotating water current.

Also, a motor 50 used for rotating the inner tub 35 and the pulsator 40 is disposed in a lower side of the outer tub 30. The motor 50 can rotate the inner tub 35 being coupled to the inner tub 35 through a rotation axis 55; and a clutch (not shown) delivering rotational force of the motor 50 selectively to the inner tub 35 and the pulsator 40 can be disposed between the inner tub 35 and the pulsator 40. Therefore, through the clutch, either only one of the inner tub 35 and the pulsator 40 can rotate or both of the inner tub 35 and the pulsator 40 can rotate simultaneously.

Meanwhile, in the top cover 200, a detergent box 60 to store a detergent is disposed in such a way that it can be drawn in or out; also disposed are a supply water hose (not shown) for providing washing water to a detergent box 60 from an external water source; and a supply water valve 75 to regulate washing water flowing through the supply water hose (not shown). If washing water is supplied from an external water source as the supply water valve 75 is opened, washing water supplied flows into the detergent box 60 and is provided to the inner tub 35.

Washing water supplied from the detergent box 60 to the inner tub 35 flows through a plurality of water holes formed in the inner tub 35 and is contained in the outer tub 30; and laundry is contained in the inner tub 35.

Also, in a lower part of the outer tub 30, disposed are a drain hose 80 for draining washing water in the outer tub 30 to the outside and a drainage adjustment valve 85 for controlling washing water drained through the drain hose 80. Also, a drain pump 86 is disposed and drains washing water to the outside.

FIG. 3 illustrates a side view of a lid assembly 100 and a top cover 200 according to one embodiment of the present invention.

With reference to FIG. 3, disposed are a top cover 200 where a laundry entrance hole H is formed through which laundry is put in from above; a lid assembly 100 coupled to the top cover 200 in a rotatable manner and opening and closing the laundry entrance hole H; and a control panel 400 in the rear part of an upper side of the top cover 200.

A laundry entrance hole H is formed in the center of the top cover 200 and the user can put in or take back laundry from above.

The lid assembly 100 is combined with the top cover 200 in a rotatable manner. The user can open or close the laundry entrance hole H by using the lid assembly 100. At this time, a state where a lid assembly 100 represented by a dotted line of FIG. 3 has closed the laundry entrance hole H is defined as a closed state; and a state where a lid assembly 100 represented by a solid line has opened the laundry entrance hole H is defined as an open state. The lid assembly 100 is opened making a predetermined angle while in the closed state; an open state where the lid assembly 100 can assume a maximum angle before interfering with the control panel 400 due to rotation is defined as a maximum opening angle.

The maximum opening angle corresponds to an angle ranging from 100 degrees to 120 degrees with which the lid assembly 100 is opened with respect to the close state. It is preferred that θ shown in FIG. 3 corresponds to 100 degrees to 120 degrees.

With reference to FIG. 4, a washing machine W according to one embodiment of the present invention comprises a top cover 200 where a laundry entrance hole H is formed through which laundry is put in from above; a lid assembly 100 coupled to the top cover 200 in a rotatable manner and opening and closing the laundry entrance hole H; and a stopper 141 being formed at least in one of the top cover and the lid assembly and preventing the lid assembly 100 from being rotated more than a maximum opening angle.

A stopper 141 according to one embodiment of the present invention as shown in FIG. 4 is formed being extended from the lid assembly 100. The stopper 141 performs a function of restricting an opening angle so that the lid assembly 100 at a maximum opening angle is not allowed to rotate further. The stopper 141 is inserted to a stopper guide hole 213 formed in the top cover 200 and the stopper 141 moves inside the stopper guide hole 213.

A stopper guide hole 213 is formed being depressed in the top cover 200. A stopper 141 is inserted in the stopper guide hole 213 and the stopper guide hole 213 restricts the lid assembly 100 rotating more than a maximum opening angle.

As the lid assembly 100 rotates, the stopper 141 moves inside the stopper guide hole 213. A locker 214 described later is formed in one side of the stopper guide hole 213; when the lid assembly 100 reaches a maximum opening angle, the stopper 141 is caught by the locker 214 and thus further rotation of the lid assembly 100 is blocked.

In other words, as the lid assembly 100 rotates, the rotational movement range of the stopper 141 is restricted to the range of the stopper guide hole 213; and the stopper 141 is caught by the locker 214 to prevent the lid assembly 100 from being rotated more than a maximum opening angle. If the stopper 141 is caught by the locker 214, the lid assembly 100 is not allowed to move further.

Length L of the stopper guide hole 213 functions to restrict a rotational range of the lid assembly 100. If the length L of the stopper guide hole 213 is short, excursion distance of the stopper 141 becomes short, leading to a small angular range for rotation of the lid assembly 100. Meanwhile, if the length L of the stopper guide hole 213 is long, the excursion distance of the stopper 141 becomes long, leading to a large angular range for rotation of the lid assembly 100. Therefore, a preferred length L of the stopper guide hole 213 should be so formed that angular excursion for rotation of the lid assembly 100 determined according to the movement of the stopper 141 ranges from 100 degrees to 120 degrees with respect to the closed state.

In the stopper guide hole 213, formed is a locker 214 catching the stopper 141 at a maximum opening angle of the lid assembly 100. If the stopper 141 reaches the locker 214 while moving along the stopper guide hole 213, further movement of the stopper 141 is blocked by the locker 214. The blocking position of the locker 214 is formed at the position corresponding to a maximum opening angle of the lid assembly 100, allowing the lid assembly 100 to be opened until the maximum opening angle is reached.

The locker 214 determines a maximum opening angle. More specifically, when the lid assembly 100 rotates in front of the control panel 400, the lid assembly reaches a maximum opening angle due to rotation, the maximum opening angle being determined by the angle where the lid assembly 100 does not interfere with the control panel 400 if the lid assembly 100 is opened by rotation. At this time, a maximum opening angle is varied according to the position at which the locker 214 blocks the stopper 141. In other words, if the lid assembly 100 is opened, the stopper 141 being formed protruding from the lid assembly 100 moves along the stopper guide hole 213 and the locker 214 formed in one side of the stopper guide hole 213 blocks further movement of the stopper 141, restricting opening of the lid assembly 100.

At this time, if the locker 214 is positioned much further from the control panel 400, the lid assembly 100 can be opened more than the maximum opening angle. Therefore, the locker 214 formed in one side of the stopper guide hole 213 restricts the maximum opening angle of the lid assembly 100, preventing the lid assembly 100 from making contact with the control panel 400.

A protruding part 170 is formed being protruding from the lid assembly 100 to have the lid assembly 100 make contact with the control panel 400 when the lid assembly 100 is attempted to rotate more than a maximum opening angle. At this time, due to damage of the stopper 141 or imprecise mechanical molding, the lid assembly 100 sometimes rotates further beyond a maximum opening angle. If the lid assembly 100 makes additional rotation beyond the maximum opening angle, the lid assembly 100 may collide with the control panel 400, leading to damage of the respective components. The protruding part 170 formed being protruding from the lid assembly 100, when the lid assembly 100 is attempted to rotate further beyond a maximum opening angle, makes contact with the control panel 400, preventing the lid assembly 100 and/or the control panel 400 from being damaged.

The protruding part 170 is formed on a top surface of the lid assembly 100. With respect to the closed state of the lid assembly 100, an upper plane unit of the lid assembly 100 corresponds to the top surface thereof. The protruding part 170 is formed in a position of the top surface close to the control panel 400 so that when the lid assembly 100 reaches the maximum opening angle, the protruding part 170 may either be positioned close to or make minute contact with the control panel 400.

The lid assembly 100 includes a door glass 150 in the center thereof. A door glass 150 can be made of any material formed by transparent material so that the user can see the laundry entrance hole H. As a most preferred embodiment of a door glass, glass can be used.

A door glass 150 is relatively heavy owing to the inherent characteristics thereof. When the lid assembly 100 rotates toward the control panel 400, the lid assembly 100 may collide with the control panel 400, leading to damage of the door glass 150. To prevent the damage, the lid assembly 100 is equipped with a stopper 141, avoiding making contact with the control panel 400 at a maximum opening angle.

The protruding part 170 is formed in a lower side of the door glass 150. With respect to the state where the lid assembly 100 reaches the maximum opening angle, downward side along vertical direction of the lid assembly 100 corresponds to a lower side direction. The door glass 150 is installed inside the lid assembly 100 parallel to the lid assembly 100; if the lid assembly 100 belongs to the open state, the door glass 150 also gets into the open state. At this time, the protruding part 170 being formed in lower side direction of the door glass 150, when the lid assembly 100 is attempted to rotate further beyond a maximum opening angle, makes contact with the control panel 400, preventing the door glass 150 from colliding with the control panel 400 and being damaged.

With reference to FIGS. 5 and 6, the top cover 200 incorporates a mounting part 212 which is formed being depressed and has a stopper guide hole 213 to mount the lid assembly 100. The mounting part 212 is formed being depressed in inward direction to mount the lid assembly 100 and formed in a space close to the control panel 400. The mounting part 212 is formed being depressed not to interfere with rotation of the lid assembly 100. Also, the aforementioned stopper guide hole 213 is formed being depressed in the mounting part 212. The stopper guide hole 213 can be formed being depressed in the center of the mounting part 212.

With reference to FIG. 7, a lid assembly 100 comprises a lid upper frame 110 forming an external appearance; an inner lid 120 disposed at an inner side of the lid upper frame 110 and supporting the lid upper frame 110; a lid lower frame 130 being installed in a lower part of the inner lid 120 and fastened to the lid upper frame 110. Also, a protruding part 170 is formed on a top surface of the lid upper frame 110.

The lid upper frame 110 is made of metal and/or plastic material with excellent strength, forming an external appearance of the lid assembly 100.

The inner lid 120 is combined between the lid upper frame 110 and the lid lower frame 130 described below; and supports the lid upper frame 110. The inner lid 120 can employ any material which has strength enough to support the lid upper frame 110. Also, the inner lid 120 is formed with a width thicker than that of the lid lower frame 120 described below. Description thereof is provided together with the lid lower frame 130.

The lid lower frame 130 is combined with the lid upper frame 110 and disposes the inner lid 120 in an inner side thereof. The inner lid 120 is combined between the lid upper frame 110 and the lid lower frame 130; and supports the lid upper frame 110 and the lid lower frame 130. The lid lower frame 130 is combined with the lid upper frame 110, thus forming an external appearance.

The lid assembly 100 further comprises a door glass 150 between the lid upper frame 110 and the lid lower frame 130. The door glass 150 adheres closely to the lid lower frame 130 by the inner lid 120. A door glass 150 can be made of transparent material so that the user can see the laundry entrance hole H. As a most preferred embodiment of a door glass, glass can be used.

The stopper 141 comprises a lid inner stopper 121 formed being protruding from one side of the inner lid 120; and a lid lower frame stopper 131 protruding from one side of the lid lower frame 130 and being formed corresponding to the lid inner stopper 121.

In one side of the inner lid 120, formed is a lid inner stopper 121 being combined with the inner lid 120 as a single body and being formed protruding from the same plane of the inner lid 120. The lid inner stopper 121 is made of the same material as the inner lid 120. The lid inner stopper 121 should be made of material with high strength, preferably material resisting plastic deformation, not being bent by a supporting locker 214.

A lid lower frame stopper 131 is formed in one side of the lid lower frame 130, the lid lower frame stopper 131 protruding with the lid lower frame 130 as a single body. The lid lower frame stopper 131 is combined with the lid inner stopper 121, forming an appearance corresponding to the lid inner stopper 121.

The stopper 141 to which the lid lower frame stopper 131 and the lid inner stopper 121 are fastened moves along the stopper guide hole 213. At this time, as the stopper is caught by the locker 214, one side of the stopper 141 can be bent or deformed due to the weight of the lid assembly 100. In case of plastic deformation, whitening occurs where the lid lower frame stopper 131 of the lid lower frame 130 is deformed to be whitened. In order to prevent the whitening, the lid lower frame 130 employs such material as having elasticity and resisting plastic deformation. Preferably reinforced plastic made by incorporating elastic material is desired, but material is not limited thereto.

The whole of the stopper 141 can be bent or damaged due to plastic deformation. To prevent plastic deformation, thickness of the inner lid 120 formed as a single body with the lid inner stopper 121 is so formed as to endure plastic deformation. Preferably, thickness of the inner lid 120 is made thicker than that of the lid lower frame 130. If the thickness of the inner lid 120 is formed to be thicker than that of the lid lower frame 130, load applied to the stopper 141 can be supported by the inner lid 120, thereby preventing damage of the stopper 141 due to plastic deformation.

As another embodiment of the present invention, as shown in FIG. 7, the stopper 141 further comprises a lid upper frame stopper 111 formed being protruding from one side of the lid upper frame 110. In one side of the lid upper frame 110, too, corresponding to the lid inner stopper 121 and the lid lower frame stopper 131 described above, the lid upper frame stopper 111 is formed by protruding together with the lid upper frame 110 as a single body. The lid upper frame stopper 111, the lid inner stopper 121, and the lid lower frame stopper 131 can be combined together to form a single stopper 141.

A protruding part 170 is formed on a top surface of the lid upper frame 110. The protruding part 170 is made of the same material as the lid upper frame 110 and is formed in a space of the top surface of the lid upper frame 110 close to a rotation axis. If the lid upper frame 110 is rotated up to a maximum opening angle as a part of the lid assembly 100, the lid upper frame 110 and the control panel 400 become positioned close to each other. Since the protruding part 170 is formed in a space of the top surface of the lid upper frame 110 close to the rotation axis, the protruding part 170 is positioned close to the control panel 400. In case the lid assembly 100 rotates over the maximum opening angle, the lid assembly 100 is prevented from being damaged as the protruding part 1'70 makes contact with the control panel 400.

The protruding part 170 neighbors the control panel 400 and is formed parallel to the rotation axis X around which the lid assembly 100 rotates. The protruding part 170 is formed in a space among parts of the lid assembly 100 close to the control panel 400. More specifically, when the lid assembly 100 rotates around a rotation axis X from a close state to an open state, the protruding part 170 is formed parallel to the rotation axis X and in a space close to the control panel 400. The protruding part 170 formed as described above prevents damage by making contact with the control panel 400 when the lid assembly 100 rotates more than a maximum opening angle.

With reference to FIG. 8, the stopper 141 forms holes 160 in the center thereof and screws penetrate the holes for fastening. In one embodiment of the present invention, a hole 160 is formed in the lid inner stopper 121 and the lid lower frame stopper 131 through which a screw passes; a screw passes through the hole 160 and fastens the lid inner stopper 121 and the lid lower frame stopper 131 as a single body. Since the stopper 141 where the lid inner stopper 121 and the lid lower frame 130 have been fastened by screws into a single body has excellent assembly strength, at the time of rotation of the lid assembly 100, the lid assembly 100 is reliably supported by the locker 214. At this time, a screw includes all the possible means for fastening a plurality of stoppers 141 into a single body by passing through the holes 160.

As shown in FIG. 8, in another embodiment of the present invention, a hole 160 is formed in the lid upper frame stopper 111, the lid inner stopper 121, and the lid lower frame stopper 131 through which a screw passes; a screw passes through the hole 160 and fastens the lid upper frame stopper 111, the lid inner stopper 121, and the lid lower frame stopper 131 as a single body. The lid inner stopper 121 is installed in an inner side of the lid upper frame stopper 111 and the lid lower frame stopper 131, not being exposed to the outside.

In still another embodiment of the present invention, a hook is formed in at least one of the lid inner stopper 121 and the lid lower frame stopper 131; and a connecting part to which the hook is connected is formed in the other one. When a hook is formed in the lid inner stopper 121, the hook is formed in the lid lower frame stopper 131 and both the stoppers 141 are firmly combined with each other; in the opposite case, too, both the stoppers 141 are combined in the same way as described above. Owing to the combination above, the stopper 141 is supported by the locker 214, thus reliably supporting the lid assembly 100.

With reference to FIG. 9, a washing machine W according to one embodiment of the present invention comprises a top cover 200 where a laundry entrance hole H is formed through which laundry is put in from above; a lid assembly 100 coupled to the top cover 200 in a rotatable manner and opening and closing the laundry entrance hole H; a first hinge 300 connecting the top cover 200 and the lid assembly 100; and a cam 300A installed in the first hinge.

A first hinge 300 is formed in a place where the lid assembly 100 and the top cover 200 are combined together. The first hinge 300 is formed in one side of the lid assembly 100 and a second hinge 500 is formed in the other side. The first hinge 300 can be formed being depressed to the inside of the lid assembly 100. Also, the first hinge 300 can be formed being depressed to the inside of the top cover 200; in what follows, the first hinge 300 is assumed to be formed in the lid assembly 100. The assumption above does not limit the spirit and the scope of the present invention; and the first hinge 300 covers all the possible combination between the lid assembly 100 and the top cover 200 combined in a rotatable manner.

The first hinge 300 is equipped with a cam 300A. According to an embodiment where the first hinge 300 is formed in either the lid assembly 100 or the top cover 200, the cam 300A is installed in the first hinge 300, allowing the lid assembly 100 and the top cover 200 to rotate.

The lid assembly 100 further includes a second hinge 500 which generates friction force in the opposite direction of the rotation of the lid assembly 100 and controls rotational speed of the lid assembly 100. At this time, the first hinge 300 is equipped in one side of the lid assembly 100; and the second hinge 500 is equipped in the other side of the lid assembly 100 and is arranged along with the first hinge 300 on the same rotation axis X.

The second hinge 500, in the same way as the first hinge 300 described above, covers all the possible combination between the lid assembly 100 and the top cover 200 combined in a rotatable manner. In the second hinge 500, installed is an apparatus generating friction force in the opposite direction of when the lid assembly 100 is closed. Preferably a shaft damper 300B can be installed but does not limit the spirit and the scope of the present invention.

In what follows, a shaft damper is employed for one embodiment. A shaft damper 300B is an apparatus which reduces a rotational speed by applying force in the opposite direction of rotational direction; and can use hydraulic power or restoring force of coil spring. The shaft damper 300B generates friction force in the opposite direction of rotation of the lid assembly 100, allowing the lid assembly 100 to rotate reliably.

The second hinge 500 and the first hinge 300 are arranged along the same axis centering round a rotation axis X. Both the first 300 and the second hinge 500 are so combined that the top cover 200 and the lid assembly 100 can make rotations, allowing the lid assembly 100 to open and close the laundry entrance hole H.

With reference to FIGS. 10 and 11, a washing machine W according to another embodiment of the present invention comprises a top cover 200 where a laundry entrance hole H is formed through which laundry is put in from above; a lid assembly 100 coupled to the top cover 200 in a rotatable manner and opening and closing the laundry entrance hole H; and a stopper 341 being formed in the top cover 200 and supporting the lid assembly 100 in such a way to restrict the maximum opening angle of the lid assembly 100 when the lid assembly 100 is opened with a maximum angle.

A stopper 341 according to another embodiment of the present invention is formed being protruding in one side of the top cover 200. The stopper 341, when the lid assembly 100 reaches a maximum opening angle, supports one side of rotating part of the lid assembly 100, thus preventing the lid assembly from rotating further. If the lid assembly 100 is supported by the stopper 341, the stopper 341 restricts the maximum opening angle of the lid assembly 100. If the angle θ shown in FIG. 10 reaches a maximum opening angle, the stopper 341 formed being protruding from one side of the top cover 200 supports the lid assembly 100. The stopper 341 is formed to support one side of the lid assembly 100 when the lid assembly 100 reaches a maximum opening angle.

In an upper side of the top cover 200, the control panel 400 is further installed; and the stopper 341 is so formed that the lid assembly 100 is allowed to be opened to a maximum opening angle without interfering with the control panel 400. If the lid assembly 100 reaches a maximum opening angle by rotation, the stopper 341 supports one side of the lid assembly 100 and makes the lid assembly 100 rotate more toward the control panel 400 preventing the lid assembly 100 from interfering with the control panel 400.

The stopper 341 forms a contacting surface S1 which makes surface contact with the lid assembly 100. When the stopper 341 supports the lid assembly 100, an area which makes contact with the lid assembly 100 forms a flat contacting surface S1, making surface contact with the lid assembly 100. The contacting surface S1 is formed corresponding to a side surface S2 making contact with the lid assembly 100. In this case, the side surface S2 of the lid assembly 100 and the contacting surface S1 formed on the top cover 200 make surface contact with each other, supporting the lid assembly 100. The contacting surface S1 and the side surface S2 described above correspond respectively to a first flat surface S1 and a second flat surface S2.

The stopper 341, if the lid assembly 100 rotates to a maximum opening angle, forms a first flat surface S1 which makes contact with a second flat surface S2 described later and has flat ends; the lid assembly 100 forms a second flat surface S2 corresponding to the first flat surface S1. The ends of the stopper 341 form a first flat surface S1 which makes surface contact with the lid assembly 100. The lid assembly 100 forms a second flat surface S2 corresponding to the first flat surface S1 to make surface contact with the stopper 341. If the lid assembly 100 is rotated and supported by the stopper 341, as shown in FIG. 10, the first flat surface S1 and the second flat surface S2 make surface contact with each other.

If the second flat surface S2 is supported by the first flat surface S1 by making surface contact with each other, the lid assembly 100 reaches a maximum opening angle. More specifically, if the lid assembly 100 rotates and reaches a maximum opening angle, the second flat surface S2 formed in the lid assembly 100 makes surface contact with the first flat surface S1 formed in the stopper 341. The first flat surface S1 supports the lid assembly 100 by making surface contact with the second flat surface S2, thus preventing the lid assembly 100 from interfering with the control panel 400.

At this time, a space between one end T1 and the other end T2 of the first flat surface S1 of FIG. 11 is formed flat. One end T1 of the first flat surface S1 corresponds to a straight line parallel to a rotation axis X of the lid assembly 100; the other end T2 of the first flat surface S1 corresponds to a straight line parallel to the one end T1 of the first flat surface S1. In between the one end T1 and the other end T2 of the first flat surface S1, the first flat surface S1 is formed to make surface contact with the second flat surface S2.

A space between one end L1 and the other end L2 of the second flat surface S2 is formed flat. One end L1 of the second flat surface S2 neighbors the stopper 341 formed in one side of the lid assembly 341 and corresponds to a straight line parallel to a rotation axis X of the lid assembly 100. The other end L2 of the second flat surface S2 corresponds to a straight line parallel to the one end L1 of the second flat surface S2. In between the one end L1 and the other end L2 of the second flat surface S2, the second flat surface S2 is formed to make surface contact with the first flat surface S1.

Length T3 or T4 ranging from a rotation axis X of the lid assembly 100 to the one end of the first flat surface S1 which restricts an opening angle of the lid assembly 100 is the same as the length L3 or L4 ranging from a rotation axis X of the lid assembly 100 to the one end of the second flat surface S2. If the length T3 or T4 ranging from a rotation axis X of the lid assembly 100 to the one end of the first flat surface S1 is different from the length L3 or L4 ranging from a rotation axis X of the lid assembly 100 to the one end of the second flat surface S2, a position at which the stopper 341 supports the lid assembly 100 can be varied. If the length T3 or T4 ranging from a rotation axis X of the lid assembly 100 to the one end of the first flat surface S1 is different from the length L3 or L4 ranging from a rotation axis X of the lid assembly 100 to the one end of the second flat surface S2, the first flat surface S1 and the second flat surface S2 fail to make surface contact with each other, generating a mismatch. In this case, since the first flat surface S1 and the second flat surface S2 intended to make surface contact with each other at a maximum opening angle generate a mismatch, the first flat surface S1 supports only a part of the second flat surface S2. The lid assembly 100 rotates only by an angle amounting to a mismatch between the first flat surface S1 and the second flat surface S2, failing to reach the maximum opening angle.

Regarding the length T3 or T4 ranging from a rotation axis X of the lid assembly 100 to the one end of the first flat surface S1, the one end corresponds to either of the ends belonging to an upper side and a lower side. The one end of the second flat surface S2 also corresponds to either of the ends belonging to an upper side and to a lower side. If the respective one end belongs to an upper side (T1 and L1), the ends belonging to a lower side correspond to the other end (T2 and L2); if the respective one end belongs to a lower side (T2 and L2), the ends belonging to an upper side correspond to the other end (T1 and L1). The stopper 341 is so formed that the length (T3 or T4) ranging from a rotation axis X of the lid assembly 100 to the one end of the first flat surface S1 and the length (L3 or L4) ranging from a rotation axis X of the lid assembly 100 to the one end of the second flat surface S2 are the same, allowing the first flat surface S1 and the second flat surface S2 to make surface contact with each other.

FIG. 12 illustrates a stopper 341 according to another embodiment of the present invention. With reference to FIG. 12, the stopper 341 further includes a protruding part 343 formed being protruding from the top cover 200. The protruding part 343 is formed being protruding in one side of the top cover 200 and supports the lid assembly 100. The protruding part 343, like the stopper 341 described in detail above, is formed to restrict a maximum opening angle of the lid assembly 100. The protruding part 343 supports one side of the lid assembly 100, preventing the lid assembly 100 from rotating more than a maximum opening angle.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A washing machine, comprising:

a top cover where a laundry entrance hole is formed through which laundry is put in from above;

a lid assembly coupled to the top cover in a rotatable manner and opening and closing the laundry entrance hole;

a stopper being formed at least in one of the top cover and the lid assembly and preventing the lid assembly from being rotated more than a maximum opening angle; and a stopper guide hole formed in the top cover inserting the stopper, wherein the lid assembly comprises:

a lid upper frame forming an external appearance;

an inner lid disposed at an inner side of the lid upper frame and supporting the lid upper frame; and a lid lower frame being installed in a lower part of the inner lid and fastened to the lid upper frame; and wherein the stopper comprises:

a lid inner stopper protruding from one side of the inner lid; and a lid lower frame stopper protruding from one side of the lid lower frame and corresponding to the lid inner stopper.

2. The washing machine of claim 1, wherein the top cover incorporates a mounting part which is formed being depressed to mount the lid assembly, and the stopper guide hole is formed in the mounting part.

3. The washing machine of claim 1, wherein a length of the stopper guide hole is formed as a length to restrict angular range of rotation of the lid assembly.

4. The washing machine of claim 1, wherein the stopper guide hole forms a locker catching the stopper at the maximum opening angle of the lid assembly.

5. The washing machine of claim 4, wherein a control panel installed in the top cover is further included;

the lid assembly rotates in front of the control panel; and the maximum opening angle is so determined that the lid assembly does not interfere with the control panel if the lid assembly is opened by rotation.

6. The washing machine of claim 1, wherein the maximum opening angle is within the range of 100 degrees to 120 degrees.

7. The washing machine of claim 1, wherein the stopper further includes a lid upper frame stopper formed being protruding from one side of the lid upper frame.

8. The washing machine of claim 1, wherein a thickness of the inner lid is made thicker than that of the lid lower frame.

9. The washing machine of claim 1, wherein the lid lower frame is formed by material resisting plastic deformation.

10. The washing machine of claim 1, wherein a hook is formed in at least one of the lid inner stopper and the lid lower frame stopper; and a connecting part to which the hook is connected is formed in the other one.

11. The washing machine of claim 1, wherein the lid inner stopper and the lid lower frame stopper are connected by a screw.

12. The washing machine of claim 1, wherein a door glass is further included in between the lid upper frame and the lid lower frame.

13. The washing machine of claim 1, further comprising a control panel installed in the top cover; and a protruding part formed being protruding from the lid assembly to have the lid assembly make contact with the control panel when the lid assembly rotates over the maximum opening angle.

14. The washing machine of claim 13, wherein the protruding part is formed on a top surface of the lid assembly.

15. The washing machine of claim 13, wherein the lid assembly includes a door glass and the protruding part is formed close to a lower part of the door glass, and the lower part of the door glass is a rear part of a top surface of the lid assembly.

16. The washing machine of claim 13, wherein the protruding part is formed on a top surface of the lid upper frame.

* * * * *